US007753465B2

(12) United States Patent
Griesemer et al.

(10) Patent No.: US 7,753,465 B2
(45) Date of Patent: Jul. 13, 2010

(54) METHOD FOR GENERATING A REFERENCE SIGNAL FOR USE IN AN IMAGING APPARATUS

(75) Inventors: Frederick Charles Griesemer, Richmond, KY (US); Darrel Lee Henry, Versailles, KY (US); Michael Anthony Marra, III, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 904 days.

(21) Appl. No.: 11/549,177

(22) Filed: Oct. 13, 2006

(65) Prior Publication Data

US 2008/0144073 A1 Jun. 19, 2008

(51) Int. Cl.
*B41J 29/38* (2006.01)
*B41J 29/393* (2006.01)

(52) U.S. Cl. ..... 347/14; 347/19

(58) Field of Classification Search ..... 347/14, 347/37, 11, 6, 17, 19, 15; 358/1.15, 463; 318/640; 400/279, 705, 709; 327/311, 551, 327/552, 559, 156

See application file for complete search history.

(56) References Cited

U.S. PATENT DOCUMENTS

| | | | | |
|---|---|---|---|---|
| 4,415,286 | A * | 11/1983 | Jennings | 400/279 |
| 4,789,874 | A * | 12/1988 | Majette et al. | 347/37 |
| 5,288,157 | A * | 2/1994 | Tanaka | 400/279 |
| 6,471,319 | B1 * | 10/2002 | Adkins et al. | 347/11 |
| 6,609,781 | B2 | 8/2003 | Adkins et al. | |
| 7,036,902 | B2 * | 5/2006 | Shoji | 347/14 |
| 7,168,781 | B2 * | 1/2007 | Chen | 347/19 |
| 2005/0128235 | A1 * | 6/2005 | Hung et al. | 347/14 |

* cited by examiner

*Primary Examiner*—Stephen D Meier
*Assistant Examiner*—Rene Garcia, Jr.

(57) ABSTRACT

A method for generating a reference signal for use in an imaging apparatus having an encoder system that supplies an original encoder signal includes selecting one of a plurality of encoder signal conditioning algorithms corresponding to a plurality of desired functions, each encoder signal conditioning algorithm of the plurality of encoder signal conditioning algorithms being directed to facilitating a specific predefined function of the plurality of desired functions relating to a modification of the original encoder signal; reading values into the selected encoder signal conditioning algorithm to generate at least one programming parameter; and programming a hardware reference unit using the at least one programming parameter to generate a synthesized encoder signal representing the modification of the original encoder signal.

17 Claims, 5 Drawing Sheets

METHOD FOR GENERATING A REFERENCE SIGNAL FOR USE IN AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus, and more particularly to a method for generating a reference signal for use in an imaging apparatus.

2. Description of the Related Art

In prior art an imaging apparatus, such as an ink jet printer, forms an image on a print medium, such as paper, by applying ink to the print medium. Such an ink jet printer includes a reciprocating printhead carrier that transports one or more printheads across the print medium along a bi-directional scanning path defining a print zone of the printer. An ink jet printhead cartridge, for example, includes both an ink tank containing ink and an ink jet printhead for selectively ejecting the ink. Each ink jet printhead cartridge is mounted to the printhead carrier.

An encoder system is provided to track the movement of the printhead carrier along a bi-directional scan path. The encoder system provides a carrier encoder signal which may be used, for example, to determine carrier position, velocity, and acceleration. Typically, a print ASIC generates fire pulses in relation to the carrier encoder signal. This allows dots to be placed accurately with respect to the carrier encoder signal, even in the presence of undesired carrier motion such as vibrations. However, in practice, noise and other encoder related errors associated with the carrier encoder signal result in dot placement errors.

SUMMARY OF THE INVENTION

The invention, in one form thereof, is directed to a method for generating a reference signal for use in an imaging apparatus having an encoder system that supplies an original encoder signal. The method includes selecting one of a plurality of encoder signal conditioning algorithms corresponding to a plurality of desired functions, each encoder signal conditioning algorithm of the plurality of encoder signal conditioning algorithms being directed to facilitating a specific predefined function of the plurality of desired functions relating to a modification of the original encoder signal; reading values into the selected encoder signal conditioning algorithm to generate at least one programming parameter; and programming a hardware reference unit using the at least one programming parameter to generate a synthesized encoder signal representing the modification of the original encoder signal.

The invention, in another form thereof, is directed to a method for providing a reference signal to printhead fire logic for controlling generation of fire pulses that are supplied to a printhead in an imaging apparatus. The method includes generating an original encoder signal; selecting one of a plurality of encoder signal conditioning algorithms corresponding to a plurality of desired functions, each encoder signal conditioning algorithm of the plurality of encoder signal conditioning algorithms being directed to facilitating a specific predefined function of the plurality of desired functions relating to a modification of the original encoder signal; reading values associated with the original encoder signal into the selected encoder signal conditioning algorithm to generate at least one programming parameter; programming a hardware reference unit using the at least one programming parameter to generate a synthesized encoder signal representing the modification of the original encoder signal; selecting one of the original encoder signal and the synthesized encoder signal as the reference signal; and supplying the reference signal to the printhead fire logic.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION

Figure 1:
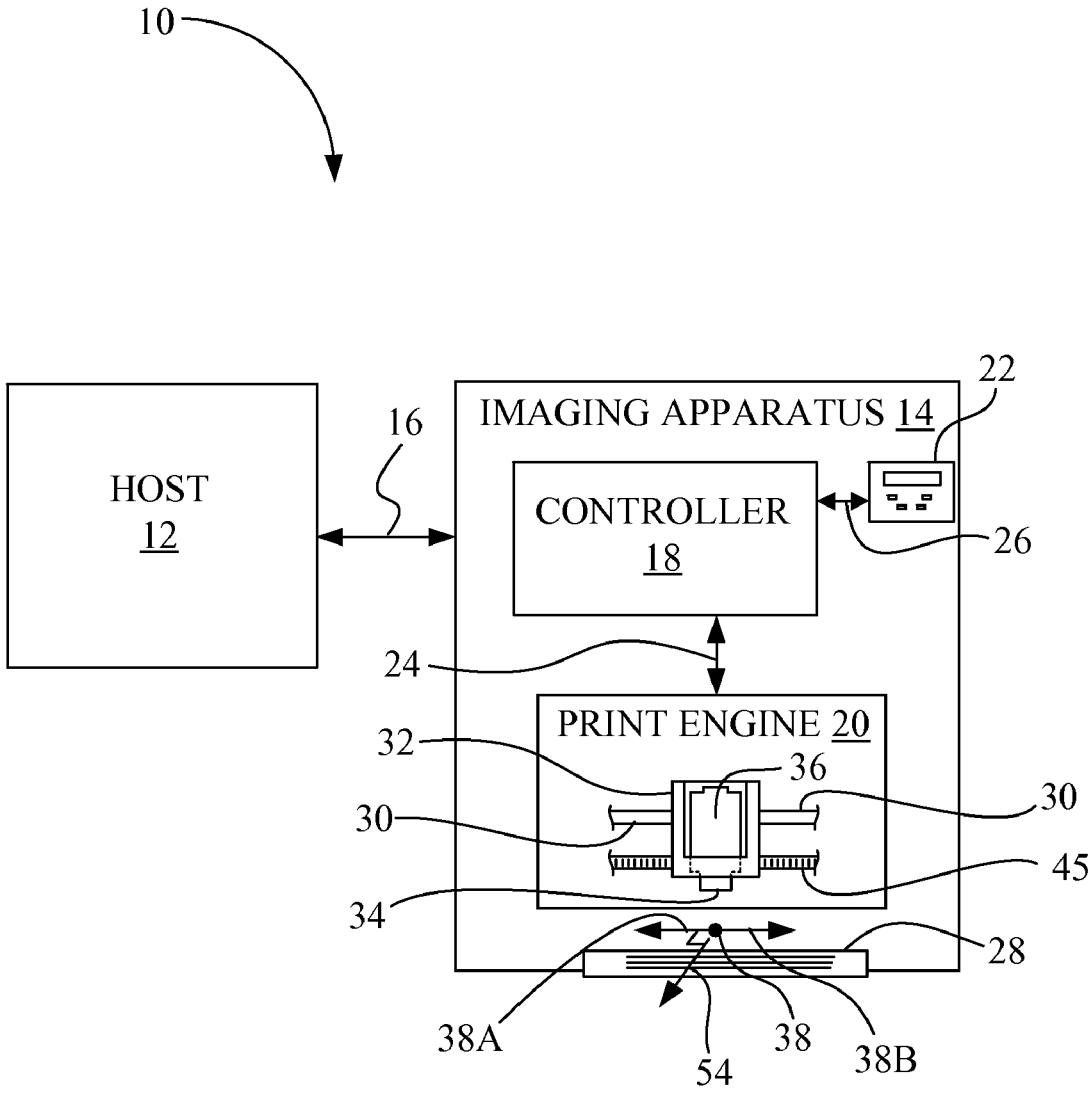
FIG. 1 is a diagrammatic depiction of an imaging system including an imaging apparatus embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention, and other alternative mechanical configurations are possible.

Referring to FIG. 1, there is shown a diagrammatic depiction of an imaging system 10 embodying the present invention. Imaging system 10 may include a host 12 and an imaging apparatus 14. Imaging apparatus 14 may communicate with host 12 over a communication link 16. As used herein, the term "communications link" is used to generally refer to structure that facilitates electronic communication between multiple components, and may operate using wired or wireless technology. Imaging apparatus 14 may communicate with host 12 via a standard communication protocol, such as for example, universal serial bus (USB), Ethernet or IEEE 802.1x, etc.

As used herein, the term "imaging apparatus" is a device that forms a printed image on a print medium. In the embodiment shown in FIG. 1, imaging apparatus 14 is shown as printer that includes a controller 18, a print engine 20 and a user interface 22. Alternatively, imaging apparatus 14 may be a standalone unit that is not communicatively linked to a host, such as host 12. For example, imaging apparatus 14 may take the form of an all-in-one, i.e., multifunction, machine that includes a scanner to facilitate standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

Controller 18 of imaging apparatus 14 includes a processor unit and associated memory, and may be formed as an Application Specific Integrated Circuit (ASIC). Controller 18 communicates with print engine 20 by way of a communications link 24. Controller 18 communicates with user interface 22 by way of a communications link 26. Communications links 24 and 26 may be established, for example, by using standard electrical cabling or bus structures, or by wireless connection.

Print engine 20 of imaging apparatus 14 may be, for example, an ink jet print engine configured for forming an image on a sheet of print media 28, such as a sheet of paper, transparency or fabric. Print engine 20 may include, for example, a guide frame 30 and a reciprocating printhead carrier 32 slidably coupled to guide frame 30. Printhead carrier 32 is mechanically and electrically configured to mount and carry at least one printhead 34. Printhead 34 is in fluid communication with an ink tank 36. In one embodiment, for example, ink tank 36 and printhead 34 may be formed as an integral printhead cartridge, so as to be replaceable as a unit. In another embodiment, printhead 34 and ink tank 36 may be designed to be separable, so as to be individually replaceable.

Guide frame 30 defines a bi-directional main scan path 38, including direction 38A and direction 38B. During a printing operation, guide frame 30 guides printhead carrier 32 back and forth along bi-directional main scan path 38, and in turn printhead carrier 32 transports printhead 34 in a reciprocating manner over an image surface of the sheet of print media 28. Printhead 34 selective ejects ink to form an image on the sheet of print media 28.

Figure 2:
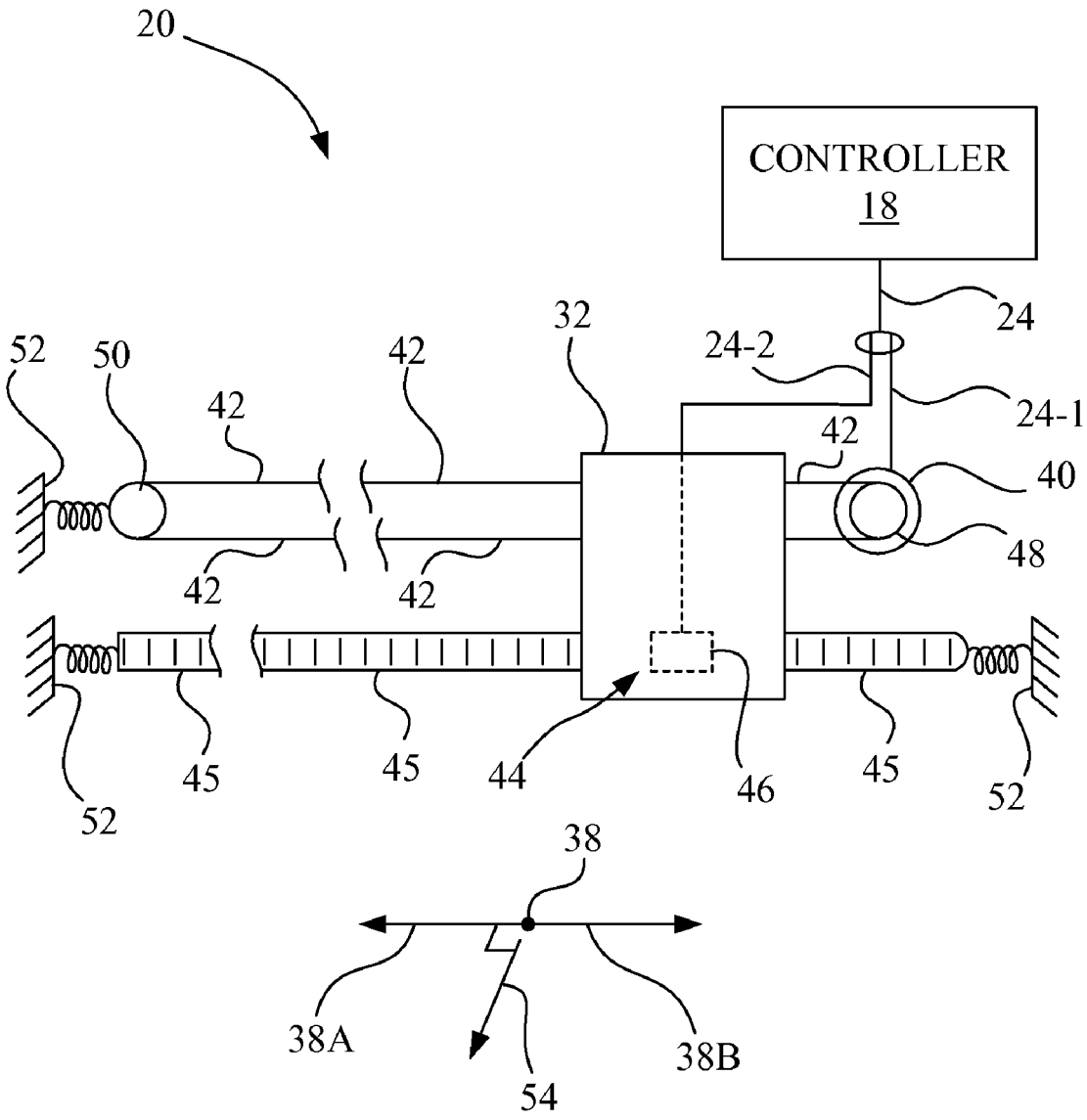
FIG. 2 is a diagrammatic representation of a portion of the print engine of the imaging apparatus of FIG. 1.

Referring also to FIG. 2, print engine 20 further includes a motor 40, a drive belt 42, and an encoder system 44. Encoder system 44 includes a linear encoder strip 45 and an encoder sensor 46. Each of motor 40 and encoder sensor 46 is communicatively coupled to controller 18 via communication paths 24-1 and 24-2, respectively, of communication link 24. Drive belt 42 is fixedly attached at its ends to printhead carrier 32. Accordingly, a rotation of a drive pulley 48 by motor 40 results in a rotation of drive belt 42 around an idler pulley 50, and in turn results in a linear movement of printhead carrier 32 along bi-directional main scan path 38, as guided by guide frame 30. Idler pulley 50 is mounted to a chassis 52 of imaging apparatus 14.

Linear encoder strip 45 extends substantially parallel to guide frame 30, and in turn, substantially parallel to bi-directional main scan path 38. The sheet of print media 28 shown in FIG. 1 is fed in a sheet feed direction 54, which is substantially perpendicular to bi-directional main scan path 38. Each end of encoder strip 45 is mounted to chassis 52 of imaging apparatus 14. Encoder sensor 46 operates in conjunction with encoder strip 45 to produce an encoder signal ES on communication path 24-2 indicative of the position, direction of movement, and/or rate of movement (i.e., velocity and/or acceleration) of printhead carrier 32 along bi-directional main scan path 38.

Figure 3:
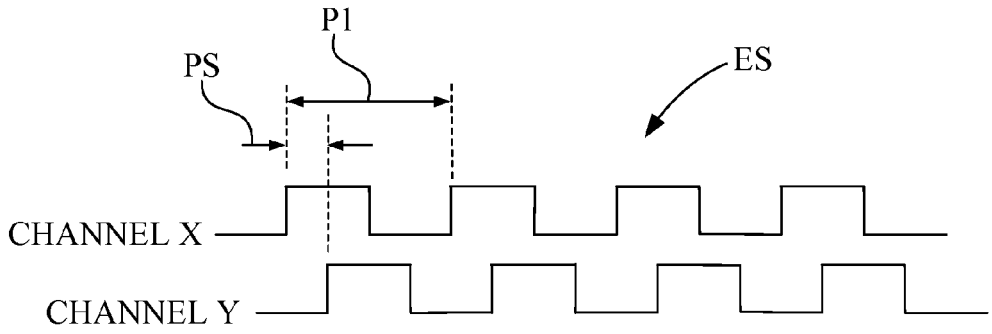
FIG. 3 is a diagrammatic representation of an encoder signal.

As illustrated in FIG. 3, in the present exemplary embodiment, encoder signal ES produced by encoder sensor 46 has a two-channel output, identified herein as Channel X and Channel Y. Each signal on Channel X and Channel Y has a period P1. The signal on Channel Y is phase shifted (PS), e.g., by 90 degrees, with respect to the signal on Channel X so as to facilitate a determination of direction, in addition to a determination of position and/or rate of movement.

Figure 4:
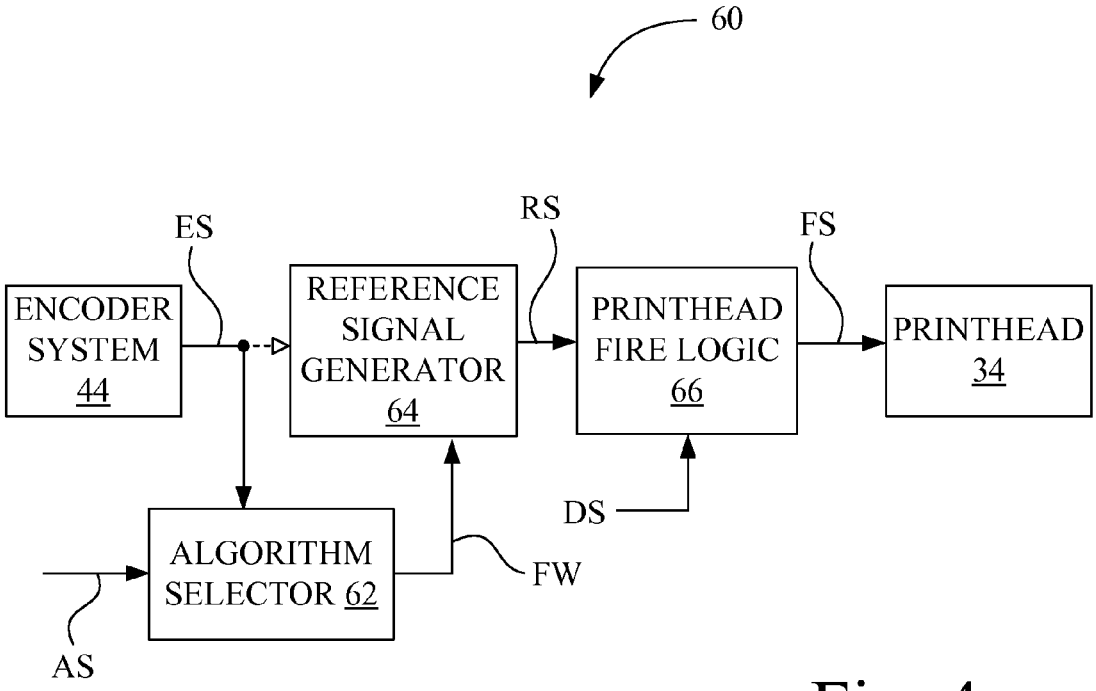
FIG. 4 is a block diagram of a print system embodied in the imaging apparatus of FIG. 1.

FIG. 4 is a block diagram of a print system 60 embodied in controller 18 and various other components of imaging apparatus 14 of FIG. 1. Print system 60 represents a combination of firmware and hardware used in selectively controlling ink ejection from printhead 34. Print system 60 includes encoder system 44, an algorithm selector 62, a reference signal generator 64, printhead fire logic 66 and printhead 34.

Encoder system 44 generates an original encoder signal ES, which is an unconditioned, i.e., "raw" encoder signal. Encoder signal ES is processed by algorithm selector 62 and reference signal generator 64, as more fully described below.

Algorithm selector 62 may be, for example, a firmware unit formed as part of controller 18 that, based on an algorithm selection signal AS, selects one of a plurality of encoder signal conditioning algorithms, which may be stored, for example, in algorithm selector 62. Each encoder signal conditioning algorithm of the plurality of encoder signal conditioning algorithms is directed to facilitating a specific predefined function of a plurality of desired functions relating to encoder signal ES, and may be used in the generation of a reference signal RS.

The plurality of desired functions may include, for example, but are not limited to: providing a filtered version of encoder signal ES; providing a constant frequency reference in order to provide constant frequency jetting at printhead 34; adjusting the timing of encoder edges of encoder signal ES based on the carrier position of printhead carrier 32, carrier velocity of printhead carrier 32, and the drop velocity of ink drops ejected from printhead 34 to provide improved printing capabilities during extreme carrier velocity variations (e.g., printing during acceleration and/or deceleration of printhead carrier 32); and modifying the horizontal print resolution (i.e., along bi-directional main scan path 38) of print engine 20, which may be beneficial for printing applications that require resolution matching to the media to be printed (such as printing on lenticular media for 3-D applications).

For example, during operation, algorithm selector 62 reads values associated with encoder signal ES, e.g., the period(s) of encoder signal ES, into the selected encoder signal conditioning algorithm representing the desired function, to generate at least one parameter which is supplied as firmware write signal FW to reference signal generator 64.

Reference signal generator 64 may be, for example, a hardware unit that is programmable via firmware write signal FW. Reference signal generator 64 processes firmware write signal FW, and optionally also encoder signal ES, in a manner more fully described below, to generate a reference signal RS.

Reference signal RS, as well as other signals, such as data signal DS, are then processed by printhead fire logic 66 to generate fire signals FS. Fire signals FS are supplied to printhead 34 to selectively actuate one or more micro-fluid ejection devices, e.g., resistive heaters, contained in printhead 34 to in turn selectively eject ink.

Figure 5:
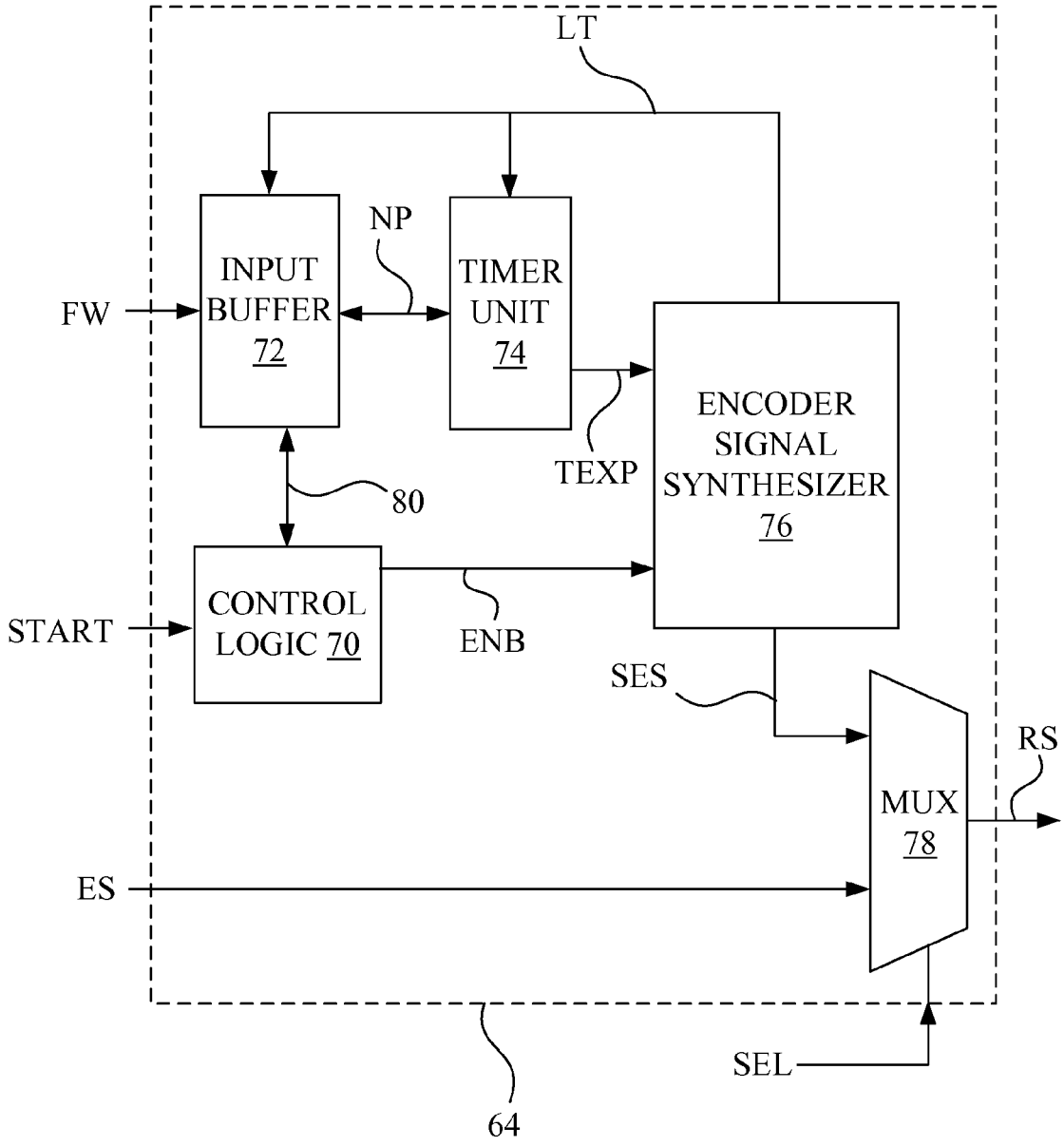
FIG. 5 is a block diagram of the reference signal generator in the print system of FIG. 4.

FIG. 5 is a more detailed block diagram of reference signal generator 64. Reference signal generator 64 includes control logic 70, an input buffer 72, a timer unit 74, an encoder signal synthesizer 76, and a multiplexer (MUX) 78. Reference signal generator 64 may be implemented, for example, as a hardware unit in or associated with controller 18.

Control logic 70 receives an initialization signal START to initiate operation of reference signal generator 64. Initialization signal START may be, for example, a signal derived from encoder system 44, such as an encoder carrier position signal designating that printhead carrier 32 is positioned at desired starting location. For example, start-up can be either synchronized to a specified encoder position of encoder system 44, at which time the generated synthesized encoder signal SES is used as input to printhead fire logic 66, or firmware may force this switch-over to start reference signal generator 64 to generate synthesized encoder signal SES. Also, an inverse of initialization signal START may be used, for example, wherein a shutdown of utilization of the generated synthesized encoder signal SES is forced or tied to the end of a print swath of printhead 34.

Control logic 70 is in bi-directional communication with input buffer 72 via communications link 80, and generates and supplies an enable signal ENB to encoder signal synthesizer 76. Enable signal ENB may be used, for example, to enable reference signal generator 64 to begin generating synthesized encoder signal SES. In addition, enable signal ENB may be used to synchronize another device or function to synthesized encoder signal SES.

Input buffer 72 may be, for example, a two-stage buffer, e.g., having two 6×18 bit buffers. The first stage of input buffer 72 buffers consecutive parameters present in firmware write signal FW until the first stage is filled, and then the contents of the first stage are transferred to the second stage of input buffer 72, at which time the first stage of input buffer 72 may again accumulate consecutive parameters present in firmware signal FW. The parameters may be, for example, a series of desired periods for the generation of synthesized encoder signal SES. Values are read from the second stage of input buffer 72 until it is empty, at which time a transfer from the first stage of input buffer 72 will occur, assuming the first stage of input buffer 72 is full. If the second stage of input buffer 72 is empty, and the first stage of input buffer 72 is not yet full and another read occurs, then the last entry in the second stage of input buffer 72 will be read again. When the first stage of input buffer 72 is finished filling, the first stage of input buffer 72 will immediately transfer its contents to the second stage of input buffer 72, and will provide an initialization request to control logic 70.

Even though input buffer 72 buffers have a maximum depth of buffering at each stage, e.g., 6 registers deep, a table depth value can be set to use less than all of the available registers in each of the stages of input buffer 72, if desired. This might be useful, for example, in situations where printhead carrier 32 is traveling at slow carrier speeds, and where very high quality is needed with less latency between firmware write signal FW writing the periods and their being used.

Each of the exemplary functions described above with respect to algorithm selector 62 requires a different level of firmware setup and maintenance of the consecutive periods, e.g., timer values, which are stored in input buffer 72. For instance, to provide a constant firing frequency as reference signal RS, the firmware is only required to setup the desired constant encoder period time and a position in which to start passing the generated synthesized encoder signal SES. Alternatively, for specific filtering characteristics, all filter calculations are done in the firmware of algorithm selector 62 and new encoder period values are provided as firmware signal FW, appropriately maintained for each encoder period. The filtering may also be done predictively, if the desired filtering characteristics allow (i.e., low-pass), so that the firmware of algorithm selector 62 may calculate several periods in advance and therefore does not have to service this function at every encoder edge.

Encoder signal synthesizer 76 generates a load signal LT, which signals input buffer 72 and timer unit 74 to transfer, i.e., load, the next parameter NP, e.g., period, to timer unit 74 from input buffer 72. Timer unit 74 may, for example, generate a desired multiple, including a factional multiple or unitary multiple, of the period supplied by input buffer 72. For example, timer unit 74 may be set to time out to generate a timer expired signal TEXP at a desired period and or quarter period, which in turn is supplied to encoder signal synthesizer 76 for generating synthesized encoder signal SES at the desired multiple of the period based on the consecutive parameters transferred to timer unit 74 from input buffer 72.

In the embodiment shown in FIG. 5, synthesized encoder signal SES produced by encoder signal synthesizer 76 may have a two-channel output, identified herein as Channel XGEN and Channel YGEN. Each signal on Channel XGEN and Channel YGEN has a period defined by the firmware write signal FW and timer unit 74. As in the case of encoder signal ES depicted in FIG. 3, the signal on Channel YGEN is phase shifted, e.g., by 90 degrees, with respect to the signal on Channel XGEN so as to facilitate a determination of direction, in addition to a determination of position and/or rate of movement, of printhead carrier 32. Control logic 70 functions to synchronize the two signal portions of synthesized encoder signal SES with the original encoder signal ES.

Depending upon the selected function, as a result of algorithm selection signal AS supplied to algorithm selector 62, synthesized encoder signal SES may be, for example, one of a filtered version of encoder signal ES, a constant frequency reference, an edge adjusted version of encoder signal ES, and a print resolution reference.

Multiplexer 78 permits a selection as between synthesized encoder signal SES and the original encoder signal ES as the outputted reference signal RS of reference signal generator 64. The selection may be made, for example, by a signal SEL supplied to multiplexer 78, for example, from controller 18 or user interface 22.

In some instances, switching back and forth between original encoder signal ES and generated synthesized encoder signal SES may result in a print carrier position counter, e.g., in controller 18, not matching the carrier position provided by encoder system 44 when launching a new print swath. One way to avoid this situation is to synchronize the print carrier position counter at the end of the generated synthesized encoder signal SES.

Figure 6:
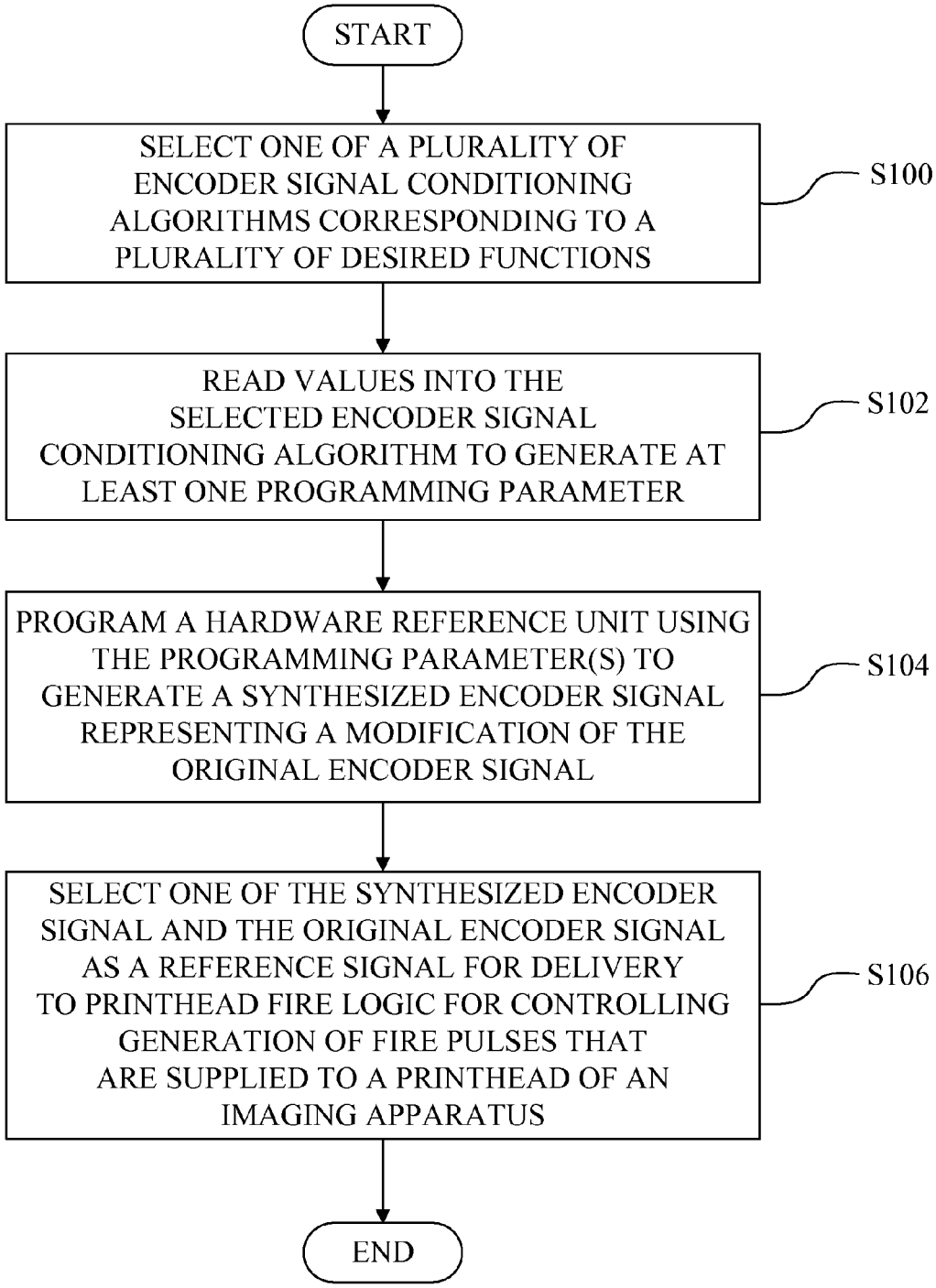
FIG. 6 is a flowchart of a method for generating a reference signal for use in the imaging apparatus of FIG. 1.

FIG. 6 is a flowchart of a method for generating a reference signal for use in an imaging apparatus, such as imaging apparatus 14, in accordance with the embodiment described above with respect to FIGS. 1-5.

At act S100, one of a plurality of encoder signal conditioning algorithms corresponding to a plurality of desired functions is selected. The selection may be made, for example, by supplying algorithm selection signal AS to algorithm selector 62 that stores the plurality of encoder signal conditioning algorithms. Each encoder signal conditioning algorithm of the plurality of encoder signal conditioning algorithms is directed to facilitating a specific predefined function relating to a modification of original encoder signal ES. Examples of such algorithms include, for example, a period multiplication algorithm, a frequency multiplication algorithm, an encoder signal filtering algorithm (e.g., a low pass filter), etc. Examples of such plurality of desired functions are described above in the discussion relating to algorithm selector 62.

At act S102, values are read into the selected encoder signal conditioning algorithm, and the selected algorithm is executed, to generate at least one programming parameter. The values read into the selected encoder signal conditioning algorithm may be, for example, a plurality of waveform periods associated with original encoder signal ES.

At act S104, a hardware reference unit, such as reference signal generator 64, is programmed using the programming parameter(s) generated at act S102 to generate synthesized encoder signal SES representing a modification of the original encoder signal ES. The programming of reference signal generator 64 occurs, for example, based on the delivery of firmware write signal FW (i.e., the programming parameters) supplied by the firmware of algorithm selector 62 to input buffer 72 of reference signal generator 64. The programming parameter(s) may be, for example, a plurality of waveform periods associated with the synthesized encoder signal SES. The synthesized encoder signal SES so generated by the hardware reference signal generator 64 is synchronized with original encoder signal ES.

At act S106, one of synthesized encoder signal SES and original encoder signal ES is selected as reference signal RS for delivery to printhead fire logic 66 for controlling generation of fire pulses that are supplied to printhead 34 carried by printhead carrier 32 in imaging apparatus 14.

The foregoing description of a method and an embodiment of the invention has been presented for purposes of illustration. It is not intended to be exhaustive or to limit the invention to the precise acts, steps and/or forms disclosed, and obviously many modifications and variations are possible in light of the above teaching. It is intended that the scope of the invention be defined by the claims appended hereto.

What is claimed is:

1. A method for generating a reference signal for use in an imaging apparatus having an encoder system that supplies an original encoder signal, comprising:

selecting one of a plurality of encoder signal conditioning algorithms, said plurality of encoder signal conditioning algorithms corresponding to a plurality of desired functions, each encoder signal conditioning algorithm of said plurality of encoder signal conditioning algorithms being directed to facilitating a specific predefined function of said plurality of desired functions relating to a modification of said original encoder signal;

reading values into the selected encoder signal conditioning algorithm to generate at least one programming parameter; and programming a hardware reference unit using said at least one programming parameter to generate a synthesized encoder signal representing said modification of said original encoder signal.

2. The method of claim 1, further comprising selecting one of said original encoder signal and said synthesized encoder signal as said reference signal.

3. The method of claim 1 wherein said specific predefined function is providing a filtered version of said original encoder signal ES.

4. The method of claim 1 wherein said specific predefined function is adjusting the timing of encoder edges of said original encoder signal based on at least one of a printhead carrier position, a printhead carrier velocity, and drop velocity of ink drops ejected from a printhead.

5. The method of claim 1 wherein said specific predefined function is modifying a horizontal print resolution along a bi-directional main scan path of said imaging apparatus.

6. The method of claim 1 wherein said plurality of encoder signal conditioning algorithms is in firmware.

7. The method of claim 1 wherein said values read into said selected encoder signal conditioning algorithm is a plurality of waveform periods associated with said original encoder signal.

8. The method of claim 1 wherein said synthesized encoder signal generated by said hardware reference unit is synchronized with said original encoder signal.

9. The method of claim 1 wherein said at least one programming parameter is a plurality of waveform periods associated with said synthesized encoder signal.

10. A method for providing a reference signal to printhead fire logic for controlling generation of fire pulses that are supplied to a printhead in an imaging apparatus, comprising:

generating an original encoder signal;

selecting one of a plurality of encoder signal conditioning algorithms, said plurality of encoder signal conditioning algorithms corresponding to a plurality of desired functions, each encoder signal conditioning algorithm of said plurality of encoder signal conditioning algorithms being directed to facilitating a specific predefined function of said plurality of desired functions relating to a modification of said original encoder signal;

reading values associated with said original encoder signal into the selected encoder signal conditioning algorithm to generate at least one programming parameter;

programming a hardware reference unit using said at least one programming parameter to generate a synthesized encoder signal representing said modification of said original encoder signal;

selecting one of said original encoder signal and said synthesized encoder signal as said reference signal; and supplying said reference signal to said printhead fire logic.

11. The method of claim 10 wherein said specific predefined function is providing a filtered version of said original encoder signal ES.

12. The method of claim 10 wherein said specific predefined function is adjusting the timing of encoder edges of said original encoder signal based on at least one of a printhead carrier position, a printhead carrier velocity, and drop velocity of ink drops ejected from said printhead.

13. The method of claim 10 wherein said specific predefined function is modifying a horizontal print resolution along a bi-directional main scan path of said imaging apparatus.

14. The method of claim 10 wherein said plurality of encoder signal conditioning algorithms is in firmware.

15. The method of claim 10 wherein said values read into said selected encoder signal conditioning algorithm is a plurality of waveform periods associated with said original encoder signal.

16. The method of claim 10 wherein said synthesized encoder signal generated by said hardware reference unit is synchronized with said original encoder signal.

17. The method of claim 10 wherein said at least one programming parameter is a plurality of waveform periods associated with said synthesized encoder signal.

* * * * *